United States Patent [19]

Meier

[11] Patent Number: 4,525,982

[45] Date of Patent: Jul. 2, 1985

[54] METHOD OF, AND APPARATUS FOR, REMOVING FLAT PRODUCTS, ESPECIALLY PRINTED PRODUCTS, FROM A WINDING CORE

[75] Inventor: Jacques Meier, Bäretswil, Switzerland

[73] Assignee: Ferag AG, Hinwil, Switzerland

[21] Appl. No.: 445,564

[22] Filed: Nov. 29, 1982

[30] Foreign Application Priority Data

Dec. 9, 1981 [CH] Switzerland ..... 7855/81

[51] Int. Cl.[3] ..... B65B 63/04; B65H 29/70; B65H 1/22

[52] U.S. Cl. ..... 53/430; 53/118; 414/29; 242/59

[58] Field of Search ..... 53/430, 118, 593, 587, 53/556, 441, 211, 212, 214; 414/29, 32, 57, 68; 242/59, 67.2, 67.3 R, 67.4, 55, DIG. 2; 270/52, 54, 56, 52.5; 226/76; 271/151, 202, 216, 203

[56] References Cited

U.S. PATENT DOCUMENTS 3,488,917 1/1970 Oswald et al. ..... 414/29 X
4,010,945 3/1977 Kistner ..... 271/225 X
4,438,618 3/1984 Honegger ..... 414/29 X

FOREIGN PATENT DOCUMENTS 2092557 8/1982 United Kingdom ..... 242/59

*Primary Examiner*—Horace M. Culver
*Attorney, Agent, or Firm*—Werner W. Kleeman

[57] ABSTRACT

Two superimposed product formations wound upon a winding core in the form of a primary product package are conjointly unwound therefrom. The product formations are separated from each other at a branching or branch location. The first product formation is immediately removed by means of a conveyor belt arrangement. The second product formation is supplied to an intermediate winding core to be wound-up thereon so as to form an intermediate product package. After emptying the primary product package the second product formation is unwound from the intermediate winding core and supplied to the conveyor belt arrangement via a deflecting roller. By means of the conveyor belt arrangement the second product formation is also consecutively removed following the previously removed first product formation. During unwinding of the intermediate product package from the intermediate winding core the empty winding core for the primary product package may be replaced by a new core containing a full primary product package without interruption in the removal of the printed products.

22 Claims, 4 Drawing Figures

METHOD OF, AND APPARATUS FOR, REMOVING FLAT PRODUCTS, ESPECIALLY PRINTED PRODUCTS, FROM A WINDING CORE

CROSS-REFERENCE TO RELATED APPLICATIONS

This application is related to (i) the commonly assigned, copending U.S. application Ser. No. 06/280,998, filed July 6, 1981, now U.S. Pat. No. 4,438,618, granted Mar. 27, 1984, entitled "Apparatus for Stacking Printed Products, such as Newspapers, Periodicals and the like, Arriving in an Imbricated Product Stream"; (ii) the commonly assigned, copending U.S. application Ser. No. 06/338,568, filed Jan. 11, 1982, now U.S. Pat. No. 4,494,359, granted Jan. 22, 1985, entitled "Method and Apparatus for the Long-term Pressing of Printed Products, Especially Newspapers"; (iii) the commonly assigned, copending U.S. application Ser. No. 06/412,843, filed Aug. 30, 1982, entitled "Winding Body for Winding-up Continuously Arriving Flat Structures, Especially Printed Products in an Imbricated Product Formation"; (iv) the commonly assigned, copending U.S. application Ser. No. 432,557, filed Oct. 4, 1982, entitled "Apparatus for the Storage of Flat Products Arriving in an Imbricated Formation, Especially Printed Products"; and, (v) the commonly assigned, copending U.S. application Ser. No. 06/445,565, filed Nov. 29, 1982, entitled "Method and Apparatus for Storing Continuously Arriving Flat Products, Especially Printed Products, and Product Package Formed from such Products".

BACKGROUND OF THE INVENTION

The present invention relates to a new and improved method of, and apparatus for, removing flat products, especially printed products, present in two formations, particularly in an imbricated formation, from a winding core. In its more particular aspects the method and apparatus for removing such products is of the type in which the products are unwound from a primary product package and delivered to respective destinations.

Unwinding apparatuses for removing products from a product package which has been formed by winding-up a product formation have been described and are known from German Patent Publication No. 2,526,432 and from German Pat. No. 1,244,656. It is a problem with such type of equipment that after discharging the products the empty winding core has to be replaced by a new product package, and thus the removal of the products is interrupted during this exchange operation. The problem may be remedied by providing two unwinding locations, wherein a respective one is operative while the other is charged or loaded with another product package. This solution, however, has the disadvantage that a considerable expense with respect to the equipment is required.

Another construction of apparatus in this field of technology has been disclosed in German Patent Publication No. 2,544,135.

SUMMARY OF THE INVENTION

Therefore, with the foregoing in mind it is a primary object of the present invention to provide an improved method of, and apparatus for, removing substantially flat products, especially printed products, particularly arranged in an imbricated product formation, from a winding core in a manner which requires only one unwinding location.

Another and more specific object of the present invention aims at the provision of a new and improved method of, and apparatus for, removing substantially flat products, especially printed products, preferably arranged in an imbricated product formation, from a winding core, in which a continuous stream of the products to be removed is ensured with but one unwinding location.

A further significant object of the present invention is directed to a new and improved method of, and apparatus for, positively and efficiently removing flat products, especially printed products, from a winding core, which apparatus is relatively simple in construction and design, quite economical to manufacture, extremely easy to use, and not readily subject to breakdown or malfunction.

Now in order to implement these and still further objects of the invention, which will become more readily apparent as the description proceeds, the method of the present development is manifested by the features that, the products are unwound from the winding core by simultaneously unwinding a first product formation and a second product formation from the product package wound upon the winding core, the first product formation being removed or transported away immediately after unwinding thereof, and the second product formation being removed or transported away with a delay and consecutively to the first product formation.

According to the apparatus aspects of the invention, wherein there is provided a first product formation and a second product formation upon the winding core, there are provided unwinding means for simultaneously unwinding the first and second product formations from the product package, and removing means for removing the unwound products. The removal or removing means contains means or structure for the direct removal or transporting away of the first product formation of both of the simultaneously wound-up product formations and for the delayed removal or transporting away of the second product formation following the first product formation.

Both of the product formations simultaneously unwound from the winding core are subjected to different treatments or manipulations. The first product formation is transported away directly from the product package, whereas the transporting away of the second product formation occurs with a time-delay. During the subsequent transporting away or removal of the second product formation an empty winding core may be exchanged against a new product package without any interruption occurring in the stream of the removed products.

Preferably, the second product formation after unwinding thereof and prior to its removal or transporting away is wound-up upon an intermediate winding core. Thus, the delay in the transporting away of the second product formation is achieved by re-winding the same prior to the actual removal or transporting away thereof.

According to a further aspect of the invention, prior to winding-up the products into a product package upon the winding core, a first leading portion of the products is initially wound-up so as to form an intermediate package and subsequently is unwound from such intermediate package and then wound together with a second, subsequent or trailing portion of the products into a primary product package. During a later simultaneous unwinding of both of these product portions the first product portion of the products can be directly transported away or removed, and the second portion of the products is wound-up into a further intermediate package and from such, following the transporting away of the first portion of the products, is subsequently unwound from such further intermediate package and transported away or removed. Due to the winding-up of each of both product portions into an intermediate package there is afforded the possibility of imparting to the products in the transported away product formation the same position as they originally possessed in the product formation delivered to the winding-up station.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
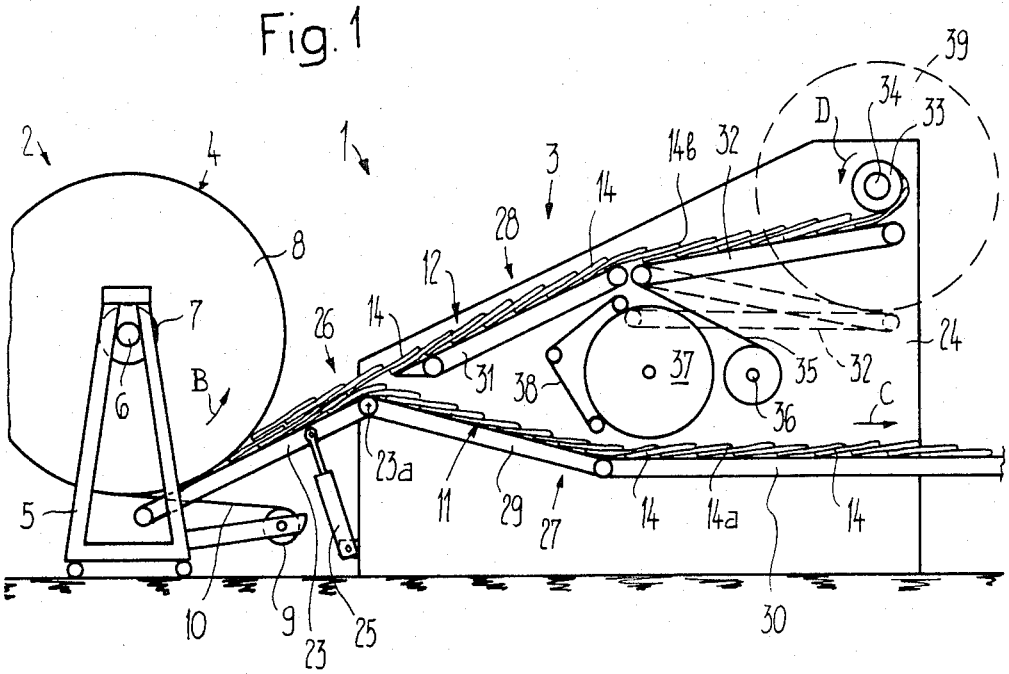
FIG. 1 is a side view of the apparatus, specifically illustrating the unwinding station, according to the invention in one operational state.
Figure 2:
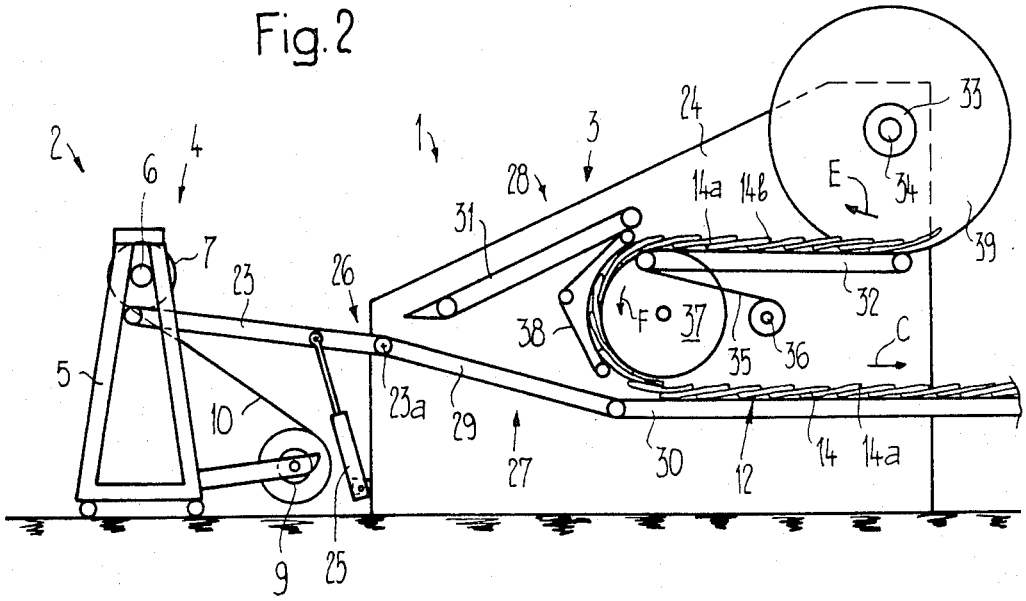
FIG. 2 is a side view of the apparatus shown in FIG. 1 in another operational state.

Describing now the drawings, it is to be understood that in order to simplify the illustration only enough of the construction of the apparatus has been shown as needed for those skilled in the art to readily understand the underlying principles and concepts of the invention. Turning now specifically to FIGS. 1 and 2, there has been illustrated therein an unwinding station 1 containing an unwinding location 2 and removing or transport means 3. A storing means or unit 4 is arranged at the unwinding location 2, the structure of which is, for example, disclosed in greater detail in the commonly assigned, copending U.S. application Ser. No. 432,557, filed Oct. 4, 1982, entitled "Apparatus for the Storage of Flat Products Arriving in an Imbricated Formation, Especially Printed Products". The storing means comprises a mobile frame or pedestal 5 in which a shaft 6 of a substantially cylindrical winding core 7 is journalled for rotation. The winding core 7 carries a primary product package 8, the structure of which will discussed more fully hereinafter. Furthermore, a band spool member 9 for a separation band 10 is rotationally journalled in the frame or pedestal 5. The separation band 10 is wound between the wound-up layers or plies of the product package 8 and it is connected to the winding core 7 at one of its ends.

The primary product package 8 is formed by two superimposed imbricated product formations 11 and 12 which are wound-up upon the winding core 7. In each of the imbricated product formations 11 and 12 the printed products 14 are superimposed in the manner of tiles of a roof. Thus, each wound-up layer or ply comprises a twin-layer. Formation of such a primary product package 8 can be achieved in various ways. In the following disclosure, a preferred technique of product package formation is described briefly with reference to FIGS. 3 and 4.

Figure 3:
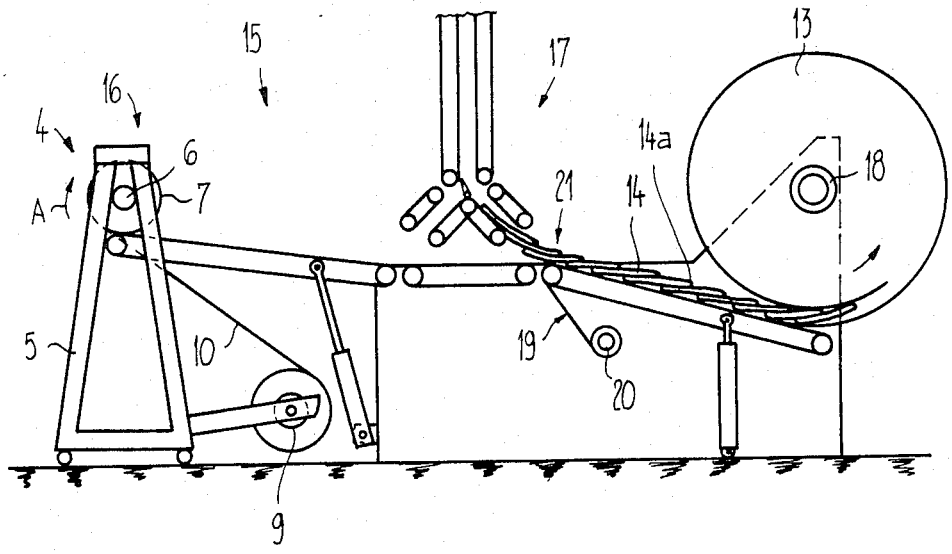
FIG. 3 is a side view of a wind-up station in the apparatus according to the invention in one operational state.
Figure 4:
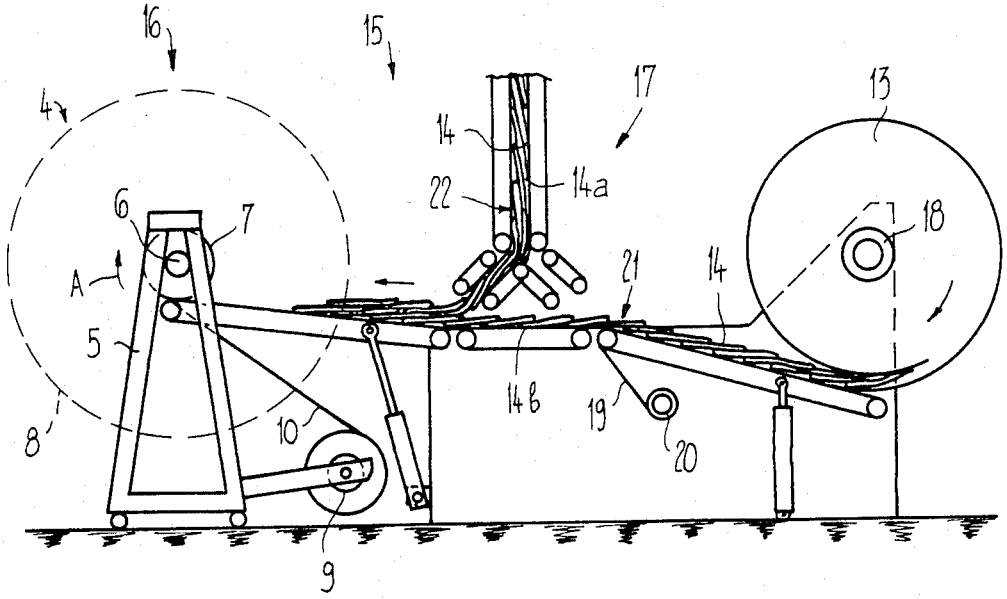
FIG. 4 is a side view of the wind-up station in the apparatus shown in FIG. 3 in a different operational state.

FIGS. 3 and 4 shown a wind-up station 15 which is the subject of and has been described in detail in the aforementioned commonly assigned, copending U.S. application Ser. No. 06/445,565, filed Nov. 29, 1982, entitled "Method and Apparatus for Storing Continuously Arriving Flat Products, Especially Printed Products, and Product Package Formed from such Products". The wind-up station 15 comprises a wind-up location or means 16 at which the empty storing or storage means 4 is located (see FIG. 3). The printed products 14 to be stored on the winding core 7 are supplied by infeeding or feeding means 17. Furthermore, a stationary winding core 18, which is appropriately journalled for rotation about its lengthwise rotational axis, is present in the wind-up station 15. One end of a separation band 19 which is wound-up on a band spool or supply member 20 is secured to the winding core 18. Formation of the primary product package 8 on the winding core 7 proceeds as follows:

A first leading product portion 21 of the stream of products to be wound-up is supplied to the winding core 18 by the infed or feeding means 17 as shown in FIG. 3. Thus, the products 14 in the first product portion 21 are wound-up upon the bidirectionally driven winding core 18 to form an intermediate product package 13, the separation band 19 being wound-up between the different layers in the intermediate product package 13. As shown in FIG. 3, the printed products 14 are wound-up on the winding core 18 with their folding edge 14*a* in the leading position.

Contrary thereto, a second trailing product portion 22 of the stream of products is directly supplied to the winding core 7 by the infeeding or feeding means 17. At the same time the first product portion 21 of the stream of products is unwound from the intermediate product package 13 and is wound-up upon the winding core 7 conjointly with the second product portion 22 as shown in FIG. 4. The printed products 14 of the second product portion 22 are thus superimposed upon the printed products 14 forming the first product portion 21. Between the individual layers or plies of the primary product package, which thus form twin layers, there is wound-up the separation or partition band 10.

As further shown in FIG. 4, the printed products 14 of the first product portion 21 are now wound-up upon the winding core 7 with their open side 14*b* in the leading position. On the other hand, the printed products 14 of the second product portion 22 are wound-up with the folding edge 14*a* in the leading position.

When the primary product package 8 is completed, the further supplied printed products 14 are again delivered to the intermediate winding core 18 to again form an intermediate product package 13. During formation of each of the intermediate product packages 13 the storing means or unit 4 can be exchanged against another storing means or unit having an empty winding core 7.

The further structure of the unwinding station 1 is now described with reference again to FIGS. 1 and 2.

The storing means or unit 4 is followed by a conveyor belt rocker or balance 23 which is journalled for pivotal movement about a pivot shaft or axis 23*a* at one of its ends in a stationary frame 24. A pressing or contact mechanism 25 comprising a loaded spring or spring storage acts on the conveyor belt rocker 23 and urges the same against the primary product package 8. A branching or branch location 26 is located at one end of the conveyor belt rocker 23. The removing or transport means 3 are divided into a first branch 27 and a second branch 28 at this location.

The first branch 27 comprises two belt or band conveyors 29 and 30 following the conveyor belt rocker 23. In the second branch 28 there is arranged a conveyor belt 31 which is followed by a conveyor belt rocker or balance 32. The conveyor belt rocker 32 is of conventional design and can be conveniently positionally adjusted in any appropriate manner. Above the conveyor belt rocker 32 there is located a winding core 33, and a bidirectionally driveable shaft 34 thereof is journalled for rotation in the frame 24. One end of a separation or partition band 35 is secured to the winding core 33. The separation band 35 is wound-up upon a band spool or supply member 36 which is rotatably journalled beneath the conveyor belt rocker 32. Furthermore, the second branch 28 includes a deflecting roller or roll 37 journalled for rotation in the frame 24; a pressing band 38 co-acts with the deflecting roller 37 and defines a conveying gap in conjunction therewith.

The operation of the unwinding station 1 is as follows:

Unwinding of both product formations 11 and 12 from the primary product package 8 is perfected in the manner described, for example, in the aforementioned commonly assigned, copending U.S. application Ser. No. 432,557, filed Oct. 4, 1982, entitled "Apparatus for the Storage of Flat Products Arriving in an Imbricated Formation, Especially Printed Products", as well as in German Patent Publication No. 3,123,888 and the corresponding British Patent Publication No. 2,081,230. By suitable drive means (not shown) the band spool member 9 is driven in such a rotational sense that the separation band 10 is withdrawn from the primary product package 8. Hence, the slightly braked winding core 7 is rotated in the direction of the arrow B. The unwound product formations 11 and 12 reach the branching or branch location 26 via the conveyor belt rocker or balance 23 and thereafter remain separated from each other.

The first product formation 11, which corresponds to the first leading portion 21 of the stream of products supplied to the wind-up station 15 (see FIGS. 3 and 4), is directly removed by means of the conveyor belts or belt arrangement 29 and 30 in the direction of the arrow C. Again the folding edges 14*a* of the removed products 14 form the leading edge, just as was the case for the imbricated product formation supplied to the wind-up station 15 (see FIGS. 3 and 4).

The second imbricated product formation 12, following the branch location 26, reaches the winding core 33, which is driven in the direction of the arrow D, by means of the conveyor belt 31 and the conveyor belt rocker 32. Thus the second product formation 12 is wound-up upon the winding core 33 to form an intermediate product package 39. The individually wound-up layers or plies are separated from each other by the separation band 35 which is wound-up in conjunction therewith. Since the band spool or supply member 36 is slightly braked the separation or partition band 35 is wound-up under tension (see FIG. 1). The conveyor belt rocker 32 follows the increase in the diameter of the wound intermediate product package 39 and is pressed thereagainst in any suitable known manner. As will be further evident from FIG. 1, the printed products 14 of the second product formation 12 leave the primary product package 8 with their open side 14*b* in the leading position and they are wound-up on the winding core 33 in this position.

After discharging or emptying the primary product package 8 the conveyor belt rocker or balance 32 is switched in its position so as to provide a connection between the intermediate product package 39 and the deflecting roll or roller 37 as shown in FIG. 2. Subsequently, the printed products 14 are unwound from the intermediate product package 39. Therefore, the band spool member 36 is driven so that the separation band 36 is withdrawn from the intermediate product package 39. The slightly braked bidirectionally driveable or rotatable winding core 33 is thus rotated in the direction of the arrow E. The unwound printed products 14 are fed by the conveyor belt rocker 32 to the not particularly referenced conveying gap formed between the deflecting roll or roller 37 and the pressing band 38, and thus are deflected through an angle of about 180°. The printed products 14 leaving the mentioned conveying gap reach the conveyor belt or band 30 by means of which they are then removed in the direction of the arrow C. As shown in FIG. 2, the leading edge of the printed products 14, unwound from the intermediate product package 39, is formed by the folding edge 14*a* thereof. Thus, after deflection at the deflecting roller 37, the printed products 14 in the stream of products having an imbricated formation, possess the same position as the printed products 14 of the first product formation 11 which have been removed or transported away prior thereto. Thus, the printed products 14 assume the same position which they had in the imbricated stream of products which was fed to the wind-up station 15 (see FIGS. 3 and 4).

In the manner described heretobefore the second product formation 12 can be removed via the conveyor belt 30 continuously and practically without any gap following the first product formation 11.

During unwinding of the second product formation 12 from the intermediate product package 39 the empty storage or storing means 4 may be exchanged for another storing means having a full primary product package 8. At the moment when the winding core 33 of the intermediate product package 39 has been emptied, the other primary product package 8 can be unwound in the manner as described hereinbefore. This means that despite the necessity of exchanging the storing means or unit 4 a practically continuous stream of products is removed or transported away from the unwinding station 1.

As described hereinbefore, the imbricated product : formation conveyed by the conveyor belt 30 has the same structure or configuration as the imbricated product formation which is supplied to the wind-up station 15 (see FIGS. 3 and 4). That is to say, the position of the printed products 14 within the entire imbricated configuration or assembly is not changed in conjunction with the wind-up and unwinding processes. However, it is also possible to effect a change in the structure of the removed imbricated product formation by a corresponding design of the infeed or feeding means 17 or the removing or transport means 3, respectively.

Formation of the primary product package 8 from two superimposed product formations 11 and 12 may also occur in other ways than in the manner described with reference to FIGS. 3 and 4. For example, two product formations supplied directly to the winding core 7 may be wound-up simultaneously.

Furthermore, it is possible to process product packages in the manner described in which the two product formations are not superimposed, but are wound-up upon the winding core 7 in juxtaposition to each other. It is to be understood that in such case the removing or transport means 3 will have to be designed differently from the arrangement shown in the drawings.

The two product formations also may be intercorrelated or interleafed with respect to one another in such a way that the products of the two product formations are arranged alternatingly in the wound-up configuration or assembly. Upon unwinding the products means will have to be provided at the branching or branch location 26 to again separate the two intercorrelated or interleafed products from each other.

In the manner described other substantially flat products also may be processed such as sheets of paper, sacks and the like. It is not absolutely required that the products are arranged in an imbricated configuration. Each product formation may comprise, instead of a number of individual products, a single elongated material web, like for instance a paper web.

While there are shown and described present preferred embodiments of the invention, it is to be distinctly understood that the invention is not limited thereto, but may be otherwise variously embodied and practiced within the scope of the following claims.

Accordingly, what I claim is:

1. A method of removing substantially flat products, especially printed products, wound in two product formations, especially imbricated formations, from a winding core, comprising the steps of:

unwinding said products from said winding core by simultaneously unwinding the first product formation and the second product formation;

directly transporting away said first product formation after unwinding the same; and transporting away said second product formation with a time-delay following the transporting away of said first product formation.

2. The method as defined in claim 1, further including the steps of:

winding-up the second product formation into an intermediate package following the unwinding thereof and prior to transporting away the second product formation.

3. The method as defined in claim 2, further including the steps of:

unwinding both the first and second product formations off the winding core from below such winding core.

4. The method as defined in claim 1, further including the steps of:

unwinding both the first and second product formations off the winding core from below such winding core.

5. A method of removing substantially flat products, especially printed products, wound in two product formations, especially imbricated formations, from a winding core, comprising the steps of:

unwinding said products from said winding core by simultaneously unwinding the first product formation and the second product formation;

directly transporting away said first product formation after unwinding the same;

transporting away said second product formation with a time-delay following the transporting away of said first product formation; and unwinding both the first and second product formations from a product package wound upon the winding core by withdrawing a separation layer which has been wound-up between wound layers of the product package.

6. method of handling continuously arriving substantially flat products, especially printed products, particularly arriving in an imbricated product formation, comprising the steps of:

winding-up a first portion of said products upon an intermediate winding core to form an intermediate product package;

unwinding said first portion of said products from said intermediate winding core;

feeding said first portion unwound from said intermediate winding core together with a second portion of said products to a primary winding core;

winding said first and second portions of said products upon the primary winding core to form a primary product package;

simultaneously unwinding both said product portions from said primary product package;

directly transporting away said first portion of said products immediately after unwinding both of said product portions;

winding-up said second portion of said products to form an intermediate product package; and transporting away said second portion of said products following the transporting away of said first portion of said products by unwinding the second portion of said products from said intermediate product package.

7. A method of handling continuously arriving substantially flat products, especially printed products, particularly arriving in an imbricated formation, comprising the steps of:

feeding a first portion of said products with a time-delay to a wind-up location;

simultaneously winding-up said first portion together with a second portion of said products at said wind-up location;

simultaneously unwinding said unwound first and second portions of said products;

directly transporting away one of said first and second portions after unwinding thereof; and transporting away the other of said first and second portions with a delay and consecutively to said transported-away one portion.

8. An apparatus for removing substantially flat products, especially printed products, wound in two product formations, especially imbricated formations, from a winding core, comprising:

unwinding means for unwinding said two product formations which define a first product formation and a second product formation from the winding core;

transport means for outfeeding the unwound first and second product formations;

said transport means comprising:

first means for the direct transporting away of the first product formation of both said simultaneously wound-up product formations; and second means for the delayed transporting away of the second product formation following the transporting away of the first product formation.

9. The apparatus as defined in claim 8, wherein:

said first means comprises a first branch for the direct transporting away of the first product formation; and said second means comprises a second branch for the delayed transporting away of the second product formation.

10. The apparatus as defined in claim 9, wherein:

said second branch is provided with a bidirectionally driveable winding core for forming an intermediate package from the second product formation.

11. The apparatus as defined in claim 10, further including:

at least one storage means for a separation band;

one end of said separation band being connected with said bidirectionally driveable winding core; and said separation band being windable between wound layers of said intermediate package.

12. The apparatus as defined in claim 11, wherein:

said at least one storage means comprises a supply spool for the separation band.

13. The apparatus as defined in claim 11, wherein:

said separation band comprises a tensioned separation band.

14. The apparatus as defined in claim 10, further including:

support means arranged forwardly of and below said bidirectionally driveable winding core; and said support means infeeding from below the products to the bidirectionally driveable winding core.

15. The apparatus as defined in claim 11, further including:

support means arranged forwardly of and below said bidirectionally driveable winding core; and said support means infeeding from below the products to the bidirectionally driveable winding core.

16. The apparatus as defined in claim 8, wherein:

the first and second product formations are wound into a primary product package upon the winding core; and said unwinding means comprising an unwinding device for withdrawing at least one separation band from the primary product package and which has been wound-up between wound layers of said primary product package.

17. The apparatus as defined in claim 16, wherein:

said unwinding device contains a driveable band spool for winding-up the separation band which is connected at one end with the winding core.

18. The apparatus as defined in claim 9, wherein:

the first and second product formations are wound into a primary product package upon the winding core; and said unwinding means comprising an unwinding device for withdrawing at least one separation band from the primary product package and which has been wound-up between wound layers of said primary product package.

19. The apparatus as defined in claim 18, wherein:

said unwinding device contains a driveable band spool for winding-up the separation band which is connected at one end with the winding core.

20. The apparatus as defined in claim 8, further including:

mobile frame means at which there is mounted the winding core.

21. The apparatus as defined in claim 20, wherein:

the first and second product formations are wound into a primary product package upon the winding core;

said unwinding means comprising an unwinding device for withdrawing at least one separation band from the primary product package and which has been wound-up between wound layers of said primary product package;

said unwinding device containing a band spool for the separation band; and said band spool being mounted at said mobile frame means.

22. The apparatus as defined in claim 9, further including:

a support element arranged beneath the winding core at which there is formed a primary product package from said product formations for transporting away from below the product formations of the primary product package; and said support means being common to both branches of said transport means.

* * * * *

UNITED STATES PATENT AND TRADEMARK OFFICE

CERTIFICATE OF CORRECTION

PATENT NO. : 4,525,982

DATED : July 2, 1985

INVENTOR(S) : Jacques Meier

It is certified that error appears in the above—identified patent and that said Letters Patent is hereby corrected as shown below:

Column 8, line 43 please delete "unwound" and insert --wound up--

Signed and Sealed this

*Twenty-second* Day of *October 1985*

[SEAL]

*Attest:*

DONALD J. QUIGG

*Attesting Officer*

*Commissioner of Patents and Trademarks—Designate*